US011168871B2

(12) United States Patent
Gotthelf et al.

(10) Patent No.: US 11,168,871 B2
(45) Date of Patent: Nov. 9, 2021

(54) ADJUSTABLE MAGNETIC INDUCTION LIGHTING FIXTURE

(71) Applicants: Philip Gotthelf, Closter, NJ (US); John C. Tomaini, Warwick, NY (US)

(72) Inventors: Philip Gotthelf, Closter, NJ (US); John C. Tomaini, Warwick, NY (US)

( * ) Notice: Subject to any disclaimer, the term of this patent is extended or adjusted under 35 U.S.C. 154(b) by 0 days.

(21) Appl. No.: 16/952,368

(22) Filed: Nov. 19, 2020

(65) Prior Publication Data

US 2021/0156547 A1 May 27, 2021

Related U.S. Application Data

(60) Provisional application No. 62/940,441, filed on Nov. 26, 2019.

(51) Int. Cl.

| | |
|---|---|
| ***F21V 19/02*** | (2006.01) |
| ***F21V 7/04*** | (2006.01) |
| ***F21V 19/00*** | (2006.01) |
| ***F21V 21/26*** | (2006.01) |
| ***F21V 7/00*** | (2006.01) |
| ***F21V 17/10*** | (2006.01) |

(52) U.S. Cl.

CPC ..... *F21V 19/02* (2013.01); *F21V 7/0025* (2013.01); *F21V 7/041* (2013.01); *F21V 17/10* (2013.01); *F21V 19/0075* (2013.01); *F21V 21/26* (2013.01)

(58) Field of Classification Search

CPC ..... F21V 7/0025; F21V 7/0033; F21V 19/02; F21V 19/0075

See application file for complete search history.

(56) References Cited

U.S. PATENT DOCUMENTS 7,303,307 B2 * 12/2007 Martin ..... H01J 61/35 313/113

2003/0067759 A1 * 4/2003 Blanchard ..... G02F 1/133605 362/23.18

(Continued)

*Primary Examiner* — Sean P Gramling

(74) *Attorney, Agent, or Firm* — Brian L. Wamsley; Ware, Fressola, Maguire & Barber LLP

(57) ABSTRACT

An improved magnetic induction lighting fixture for wide area lighting and other uses is disclosed. The magnetic lighting fixture of the present invention provides a tubular magnetic induction lamp in a lighting fixture which provides maximum light dispersion from the fixture, wherein the light dispersion and focal distance are adjustable depending on the application. Specially, the lighting fixture integrates an assembly containing the tubular magnetic induction bulb into a housing unit having a primary reflector element at the center of the housing that is specifically configured for the geometry of the magnetic induction bulb. The internal surface of the housing constitutes a secondary reflector, providing a high-efficiency reflection surface which, together with the primary reflector, provides for maximum reflection and focus of the light produced by the magnetic induction bulb. The lighting fixture further incorporates a mechanism for raising or lowering the magnetic bulb assembly within the fixture in proportion to the primary reflector element and the secondary reflector surface, providing the capability of varying or adjusting the focal length of the fixture light beam as well as disbursing the light in varying patterns.

13 Claims, 15 Drawing Sheets

(56) References Cited

U.S. PATENT DOCUMENTS

| | | | | |
|---|---|---|---|---|
| 2009/0073680 | A1* | 3/2009 | Sandoval | F21V 17/164<br>362/216 |
| 2010/0110694 | A1* | 5/2010 | Allen | F21V 7/0025<br>362/296.06 |

* cited by examiner

ADJUSTABLE MAGNETIC INDUCTION LIGHTING FIXTURE

This application claims the benefit of U.S. provisional patent application Ser. No. 62/940,441, filed Nov. 26, 2019.

BACKGROUND

1. Field of the Invention

The present invention relates to an apparatus for providing an improved magnetic induction lighting fixture with optimized illumination performance most usually employed for wide area lighting applications such as recreational, industrial and commercial uses. More particularly, the present invention provides a means for utilizing magnetic induction lighting lamps for high bay industrial and recreational styled lighting fixtures, as well as other applications. Still more particularly, the present invention provides a novel apparatus for integrating a circular or triangular magnetic induction bulb into a preferred configuration lighting fixture which provides maximum light dispersion from the assembled fixture.

Magnetic induction bulbs are high frequency light sources which operate on the same basic principles of converting electrical power into visible radiation as conventional fluorescent lamps.

In comparison, conventional fluorescent bulbs utilize electrodes to produce electrons which stimulate mercury vapor inside the fluorescent tube to emit UV radiation which in turn activates the fluorescent powder coating the inside of the bulb to convert the UV radiation to visible light. The presence of electrodes in fluorescent bulbs has imposed many restrictions on lamp design and performance and is a major factor in limiting conventional fluorescent bulb life. The loss of cathode emission materials, due to evaporation and sputtering caused by ion bombardment, limits the life of fluorescent bulbs to between 5,000 and 20,000 hours.

The fundamental differences between the magnetic induction bulbs used in the lighting fixtures of the within invention and conventional fluorescent bulbs are that the tubes of the magnetic induction bulbs are filled with inert gas and not mercury vapor, and the magnetic induction bulbs operate without electrodes. Magnetic induction means energy transfer through magnetism by external induction coils. In contrast to conventional fluorescent bulbs, the magnetic induction bulbs of the within invention utilize an encapsulated solid mercury amalgam similar to the silver/mercury amalgam used by dentists to fill cavities. The mercury amalgam is totally isolated from the main interior of the bulb, which contains inert gas and not dispersed mercury. That is, the mercury amalgam is encapsulated in a spring-loaded glass slug that is easily removable from the main tube. This system acts like a transformer with the inductor as the primary coil, while mercury ions form a single turn secondary coil. Electrical energy is coupled through the glass to excite the mercury atoms. This produces the UV radiation to interact with the phosphor coating in the tube to convert it to visible light. Typical rated life of a magnetic induction lighting system is 100,000 hours. This is determined by the life of the electronic ballast and not the bulb components.

Specifically, the present invention provides a new and novel lighting fixture for integrating a magnetic induction bulb into a unit with the required ballast and reflector, having an adjustable focal length for optimum downward and focused illumination to provide the most efficient wide area lighting fixture heretofore developed.

The lighting fixture integrates a circular tubular or triangular tubular magnetic induction bulb into a housing unit specifically designed for the geometry of the induction bulb. The reflector comprises a high efficiency reflection surface and a conical or triangular element specifically designed for the geometry of the magnetic induction bulb, which allows the lighting fixture to disburse light with maximum intensity and in varying patterns. The lighting fixture further comprises a mechanism for raising or lowering the bulb assembly within the fixture, in proportion to the reflector, providing the capability of varying or adjusting the focal length of the fixture light beam.

2. Description of the Prior Art

Wide area lighting fixtures are commonly used for both indoor and outdoor applications. Examples of indoor wide area lighting fixture uses include arenas, gymnasiums, aircraft hangers, and other large spaces, while examples of outdoor wide area lighting fixture uses include street lighting, parking structures, loading docks, sports stadiums, and ski areas, etc. These wide area lighting fixtures typically involve a light source, such as a bulb, lamp or other illuminations source, a transformer for converting a power supply to the light source's power requirements, and a reflector and/or lens system to direct the light output form the light source into a desired illumination pattern. When the lighting fixtures are elevated and their light output directed downward, a wide area can be illuminated by strategic placement of the fixtures.

The types of wide area lighting fixtures vary depending upon the particular application and lighting requirements, as do the light sources employed. However, despite the numerous types of electrical lighting fixtures disclosed by and utilized in the prior art, which have been particularly been developed for the specific objectives and express requirements of wide area lighting, the lighting apparatus which have been heretofore devised and utilized to accomplish these goals consist basically of familiar, expected and obvious configurations, combinations and arrangements of highly developed but universal lighting apparatus. High Intensity Discharge ("HID") fixtures, for example, are one of the most prevalent outdoor lighting fixtures in use today, and may include metal halide, high pressure sodium and low-pressure sodium light sources. As an example, metal halide lamps produce approximately 70-115 lumens per Watt with operating life expectancies approximately in the 5,000-20,000 hour range. However, metal halide lamps exhibit color shifting over the life of the lamp, lumen depreciation over time, long strike time to illuminate, long re-strike time, expensive lamp and fixture costs, glare from the lamp, ineffectual emergency lighting and excessive heat generation. Ceramic metal halide (pulse start) provide reduced strike and re-strike times, and improvement in reduced color shift and reduced lumen depreciation. Ceramic metal halide lamps still suffer with high costs, lamp glare, ineffectual emergency lighting and heat generation.

In addition, high pressure sodium lamps produce about 50-140 lumens per Watt with an average life expectancy of approximately 24,000-40,000 hours. Maintaining these types of light fixtures can be expensive due to the cost of the replacement light sources themselves, and the labor and equipment needed to reach the fixtures which are often in difficult to reach locations, and to dissemble them to replace the proper component. In addition, high pressure sodium lighting produces low color rendition, long strike time to illuminate and long re-strike time; expensive fixture and lamp costs, ineffectual emergency lighting and excessive heat generation.

Mercury vapor lighting is also used for wide area illumination. Mercury vapor lights provide long lamp life and highly efficient lumen generation. The disadvantages of mercury vapor lights is that they produce very bad color rendering, have long strike times to illuminate and to re-strike, have expensive fixture costs and generate heat.

More recently, light emitting diode ("LED") array lighting became utilized in wide area lighting. The efficiency of LEDs, as measured in lumens per Watt is rapidly evolving and are approaching 130 lumens per Watt with rated operating life of 50,000-100.00 hours. However, individual, discrete LEDs do not produce sufficient light output to illuminate a wide area. As a result, to produce sufficient illumination in most applications, solid-state lighting systems utilize many LEDs, such as clusters of LEDS arranged in arrays on printed circuit boards. However, these clusters create significant heat that can build up and damage the LEDs unless the heat is controlled and dissipated. Consequently, most LED lighting manufacturers mount the LEDs to large, heavy heat sinks. Moreover, LED lights produce a strobe effect that is undesirable in many applications.

Magnetic induction lighting provides many advantages over HID and LED lighting in wide area illumination, as well as many other uses. Magnetic induction lighting is similar to fluorescent lighting in that induction lighting uses the excitation of a contained gas or gases, which react with phosphors inside a lamp to produce white light. However, magnetic induction lamps excite the gases using a magnetic field, as opposed to electrodes as in fluorescent lighting. Magnetic induction lamps are rated up to 100,000 hours operating life and, consequently, are typically employed where maintenance of the lamp may be problematic. Moreover, magnetic induction lamps are energy efficient, typically operating at greater than 85 lumens per Watt. Further, induction lamps exhibit high lumen maintenance over the entire life and provide instant on and instant restrike capability, such that there is virtually no warm-up time.

In summary, a need exists for improvement of magnetic induction lighting fixtures to maximize the illumination provided by the tubular induction bulbs, and to variably focus the illumination to the desired areas. Accordingly, a need exists for a magnetic induction lighting fixture that conforms with the geometry of the magnetic induction bulb and efficiently reflects the light produced by the magnetic induction bulb in a pattern appropriate to the intended application, and having an adjustable focal length to improve the focus of the illumination to where it is most required.

SUMMARY OF THE INVENTION

The lighting fixture contemplated according to the present invention utilizes magnetic induction lighting in a new apparatus arrangement and departs substantially from the conventional concepts and designs taught and used in the prior art. In so doing, it provides a lighting fixture primarily developed to provide improved lighting from a tubular magnetic induction bulb by increasing the reflection, direction and focus of the illumination produced by magnetic induction bulbs.

It is therefore an object of the present invention to provide a lighting fixture specifically designed for the geometry of a tubular magnetic induction bulb, whether the bulb is in a circular, triangular or other configuration. It is further an object of this invention to provide a more highly efficient reflector within the lighting fixture to both disburse a maximum amount of light produced by the bulb, and also to disburse the light in varying patterns, such patterns capable of being adjusted. In that regard, it is also an object of the invention to provide a lighting fixture having a specific focal length of the light emitted, and that the focal length can be adjusted as required by the intended use, by altering the position of the magnetic induction bulb with the fixture.

Thus, the present invention provides a magnetic induction lighting fixture having a housing designed to be in conformity with the geometry of the specific magnetic induction bulb selected for the intended purpose of the lighting fixture. The magnetic induction bulb is affixed to the internal surface of the housing, through a mounting assembly. The internal surface of the housing constitutes a reflector for the light emitted by the bulb. In this regard, the reflector contains a high efficiency reflective surface and also has a conical or triangular reflector element at its center. The conical reflector element, acting as a primary reflector, reflects and focuses the light from the magnetic induction to the internal side of the housing, functioning as a secondary reflector of the light, which thus optimizes the total lighting output of the lighting fixture. The conical element is configured to be proportionate to the geometry of the bulb and enables the lighting fixture to disburse light from the bulb in varying patterns. Further, the lighting fixture provides a mechanism which allows the bulb assembly to be raised or lowered within the fixture, in proportion to the reflector, thereby adjusting the focal length of the fixture light beam.

BRIEF DESCRIPTION OF THE DRAWINGS

The methods, features, objects, and advantages according to the invention will appear and can be further understood and described in more detail with regard to the accompanying figures. The figures illustrate ways of implementing the present invention and are not to be construed as being limiting to other possible embodiments falling within the scope of the attached claims.

DETAILED DESCRIPTION OF THE INVENTION

Reference is made to the drawings FIGS. 1-11 for a description of preferred embodiments of the present invention wherein like reference numbers represent identical elements on corresponding views.

Figure 1:
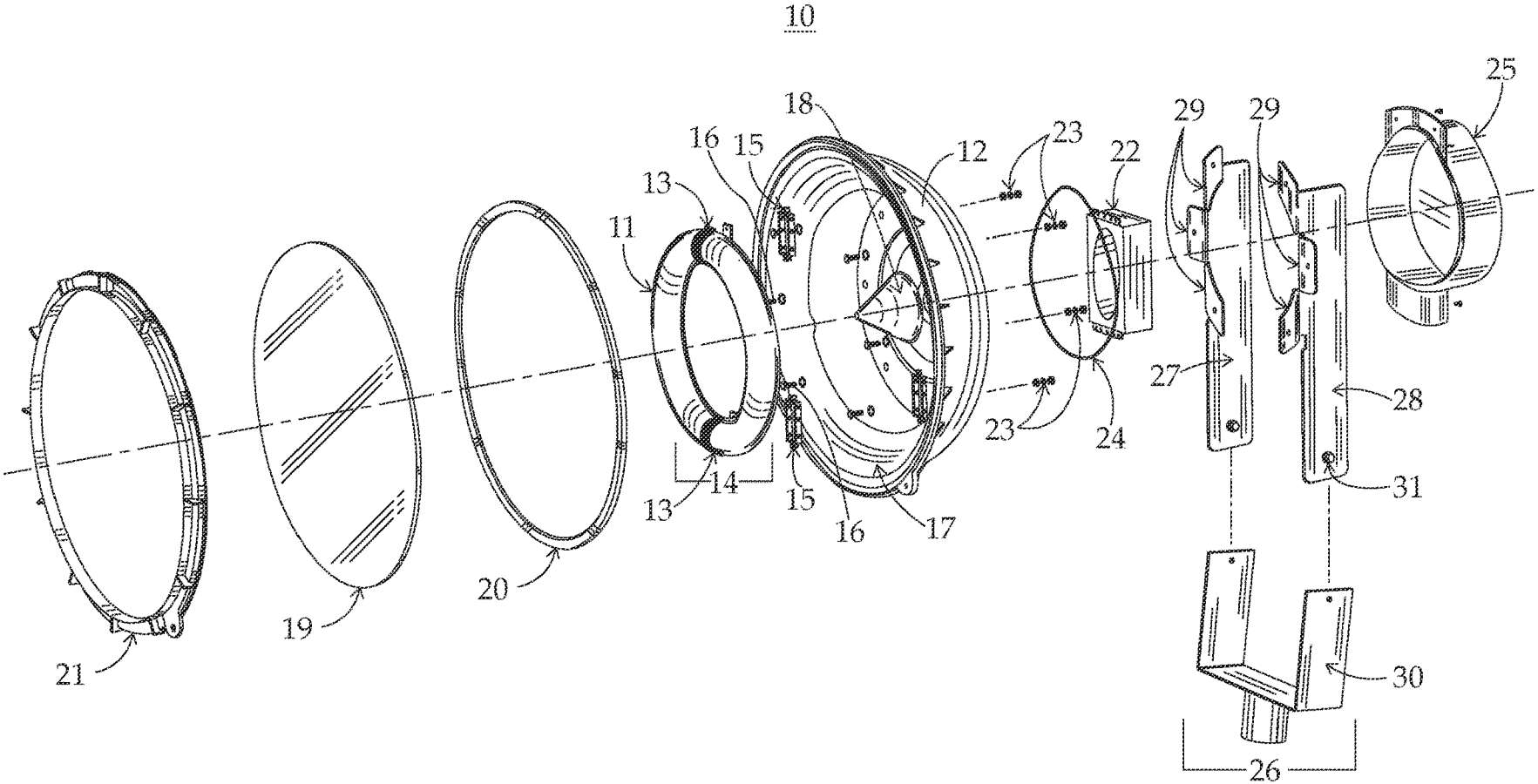
FIG. 1 is an exploded view of an embodiment of the lighting fixture of the present invention, including an embodiment of a mounting assembly for a magnetic induction bulb.

Referring now to the drawings, FIG. 1 is an exploded view of a preferred embodiment of the present invention which is a magnetic induction lighting fixture 10 designed particularly to be in conformance with a tubular magnetic induction bulb 11 to provide increased lighting efficiency and lighting of the type utilized for high bay lighting, wide area lighting, or any other type of lighting that may be served by improving lighting efficiency. In a preferred embodiment of the invention, a circular tubular magnetic induction bulb 11 is affixed inside lighting fixture housing 12 specifically configured to the geometry of the circular tubular magnetic induction bulb 11. The term "tubular," therefore, as used herein (and in the claims hereof) for describing the magnetic induction bulbs of the present invention, includes all magnetic induction bulbs that are a continuous loop, irrespective of the configuration, whether it be circular, rectangular, oval, triangular, "racetrack," or any other custom continuous shape. The diameter dimension on noncircular lamp tubes is a measurement in the plane of the tube on similar shaped tubes.

Figure 2:
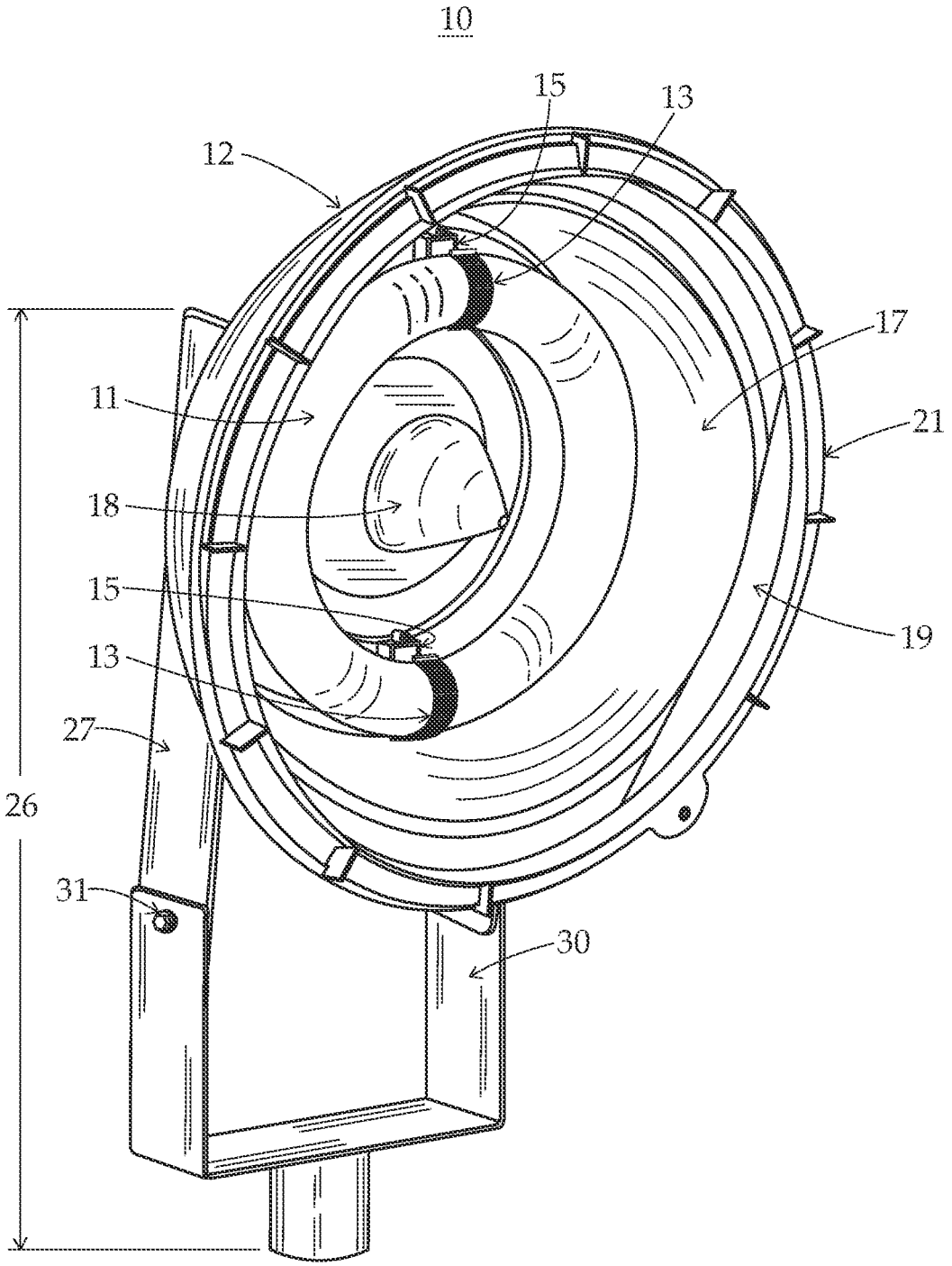
FIG. 2 is a perspective view of an assembled embodiment of the lighting fixture of FIG. 1.
Figure 3:
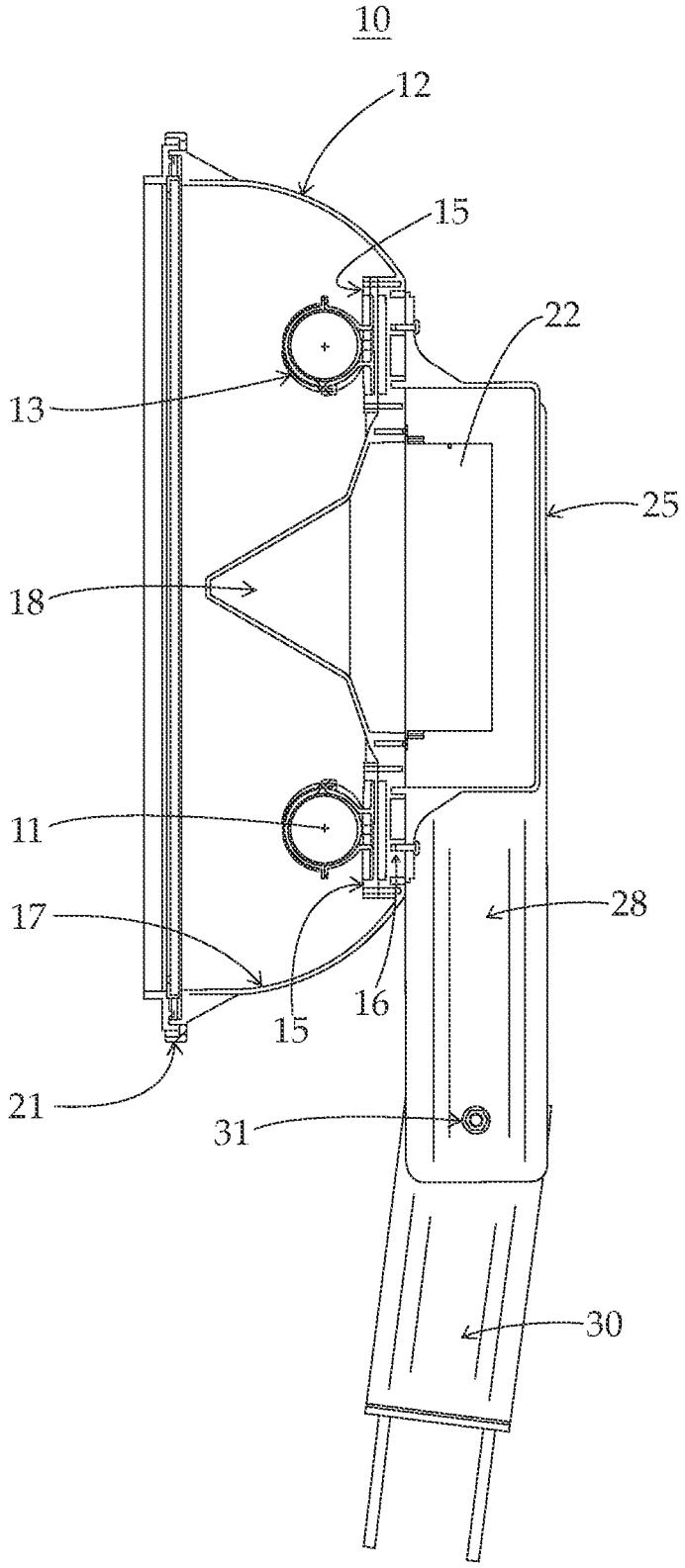
FIG. 3 is a side cross-sectional side view of the embodiment of the lighting fixture of FIG. 2.

Reference is now made to FIGS. 1-3, which comprise an exploded view (FIG. 1), a perspective assembled view (FIG. 2) and a cross-sectional view (FIG. 3) of the magnetic induction lighting fixture 10 of the within invention, and illustrate the following description of an embodiment of the invention. In a preferred embodiment of the invention, a circular tubular magnetic induction bulb 11 is secured to lighting fixture housing 12 by means of mounting assemblies 13 affixed to bulb 11. Magnetic induction bulb 11 and mounting assemblies 13 together comprise magnetic induction bulb assembly 14. Mounting assemblies 13 connect to mounting adjustment blocks 15, which are in turn affixed to the internal, reflector side of housing 12 using screws 16 or other acceptable means of attachment.

In this embodiment, lighting fixture housing 12 has a concave configuration, similar in the shape to that of a bowl, which conforms to the geometry of circular magnetic induction bulb 11 such that circular magnetic induction bulb 11 fits inside the concavity. Housing 12 is constructed of a uniform single extruded or molded piece of a suitable material, such as metal or plastic.

The internal side 17 of lighting fixture housing 12 provides a highly efficient reflector surface which functions as a secondary reflector of the light emitted from magnetic induction bulb 11. Internal side 17 also provides at its center a reflector 18, which is typically conical and circular or triangular depending on the configuration of bulb 11. However, the within invention encompasses conical reflector 18 being in various and different configurations depending on the shape and wattage of bulb 11 that is being used in fixture 10. See FIG. 9*a*. Conical reflector 18 functions as a primary reflector of lighting fixture 10 of this invention, and is located at the center of fixture housing 12 such that it is circumferentially surrounded by magnetic induction bulb 11 when bulb 11 is properly affixed to the curved internal, secondary reflector side 17 of housing 12 (also referred to herein as "secondary reflector 17"). See FIGS. 6, 7 and 7*a*. Conical reflector 18, serving as the primary reflector (also referred to herein as "conical primary reflector 18" or "primary reflector 18") of the light produced by bulb 11, reflects the light incident on its surface to the curved surface of the secondary reflector 17 which, in turn, reflects and focuses the light produced by bulb 11 outside lighting fixture 12 in accordance with the curvature of secondary reflector 17 and the distance of bulb 11 with respect to the reflecting surface of secondary reflector 17. See FIG. 9. In that regard, secondary reflector 17 consists of a highly efficient reflective surface, such as that provided by micro particles or the like as a coating on its surface. Conical reflector 18 may be molded into and become an integral part of secondary reflector 17. In at least one embodiment of the within invention conical reflector 18 is removable such that it is interchangeable with another conical or triangular reflector having a different configuration. See FIG. 11 and FIG. 9*a*. In other embodiments, primary reflector 18 may be triangular, square, rectangular or oval, for example, in order to conform to the geometry of tubular magnetic induction bulbs having those corresponding configurations. In the preferred embodiment of FIG. 1, secondary reflector 17 is configured to be in proportion to the circular geometry of magnetic induction bulb 11 in that it is round. In this embodiment, lighting fixture housing 12 is enclosed on its open side by glass window 19 under which seal 20 is positioned to provide weather-proofing. Glass window 19 and seal 20 are secured on housing 12 by locking ring 21.

Lighting fixture 10 further comprises ballast 22 positioned to the rear external side of housing 12, opposite the internal side of secondary reflector 17. Ballast 22 provides the magnetic induction energy that activates the light emission from bulb 11. Ballast 22 is affixed to housing 12 by screws 23 and is enclosed by ballast cover 25 which is affixed over ballast gasket 24 to housing 12. Ballast gasket 24 provides weather-proofing for ballast 22.

Lighting fixture 10 may be mounted in any number of locations depending on the desired use and purpose, by means of the appropriate mounting hardware. FIGS. 1-3, illustrate lighting fixture 10 together with vertical mounting bracket 26. Mounting bracket 26 is specifically designed for attachment to the back side of housing 12 and for maintaining lighting fixture 10 in an upright position while providing the ability to adjust fixture 10 to a horizontal attitude, thus providing at least a 90 degree range for directing the light beam. Accordingly, mounting bracket 26 is comprised of a right attachment member 27 and a left attachment member 28, each of which contain flanges 29 for direct attachment to the back side of housing 12. When attached to housing 12, the right attachment member 27 and left attachment member 28 form a circular opening to accommodate the protrusion of ballast cover 25 from the back side of housing 12. Right attachment member 27 and left attachment member 28 are pivotally connected to U-bracket 30, which may be mounted on a support, such as a pole, and results in the mounting of lighting fixture 10 at a selected location. This arrangement allows for a wide adjustable angle Δ of up to about 180°.

Figure 4:
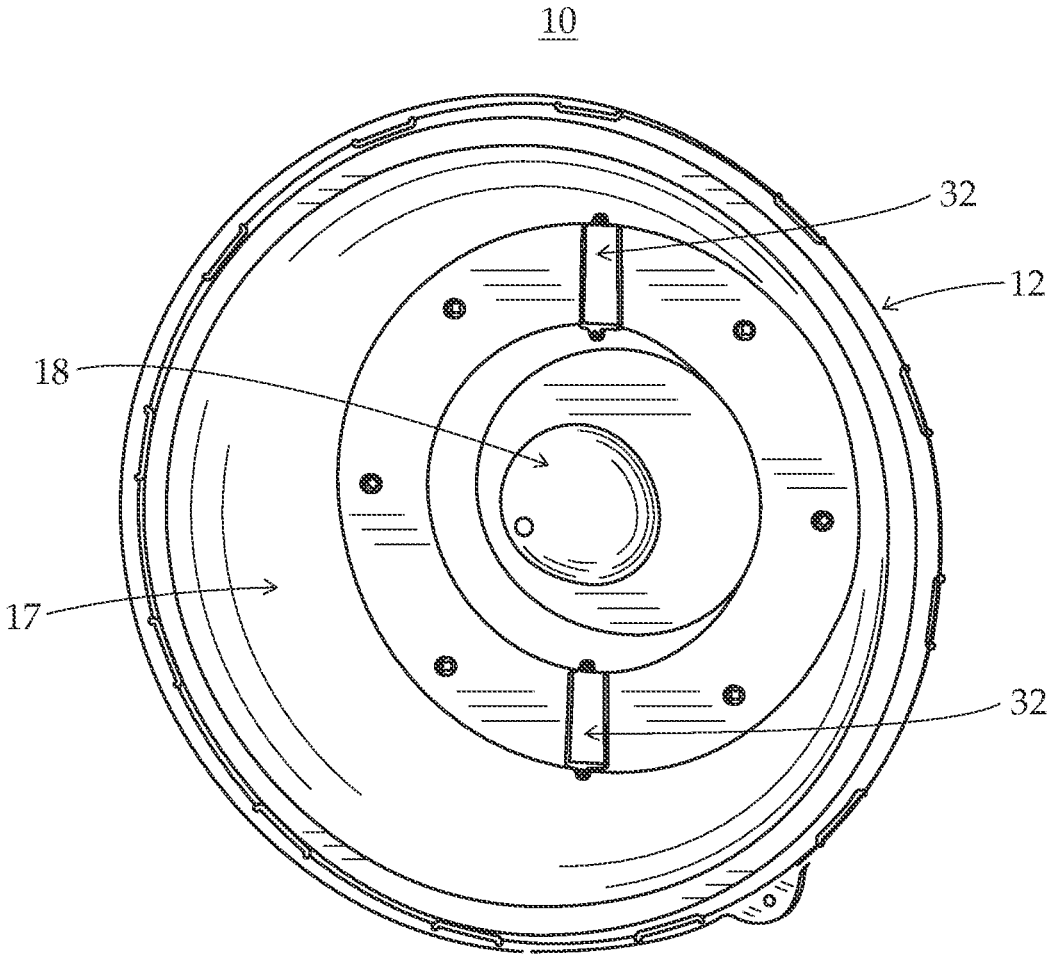
FIG. 4 is a front view of an embodiment of the housing element of the invention, showing the primary and secondary reflector elements.

FIG. 4 is a front view of housing 12 illustrating secondary reflector 17 of the housing without induction bulb assembly 14 (see FIG. 1). As seen in this embodiment, conical primary reflector 18 is located at the center of secondary reflector 17. FIG. 4 also illustrates adjustment block receptacles 32 for placement of adjustment blocks 15 for attaching bulb assembly 14 (not shown) to housing 12. In this embodiment, two adjustment block receptacles 32 are shown, although more than two may be used depending on the size and configuration of the magnetic induction bulb being attached. Thus, in attaching bulb assembly 14 to secondary reflector 17, mounting assemblies 13 are attached to adjustment blocks 15 which are positioned in adjustment block receptacles 32 and are secured with screws 16. See, e.g., FIGS. 1 and 3.

Figure 5:
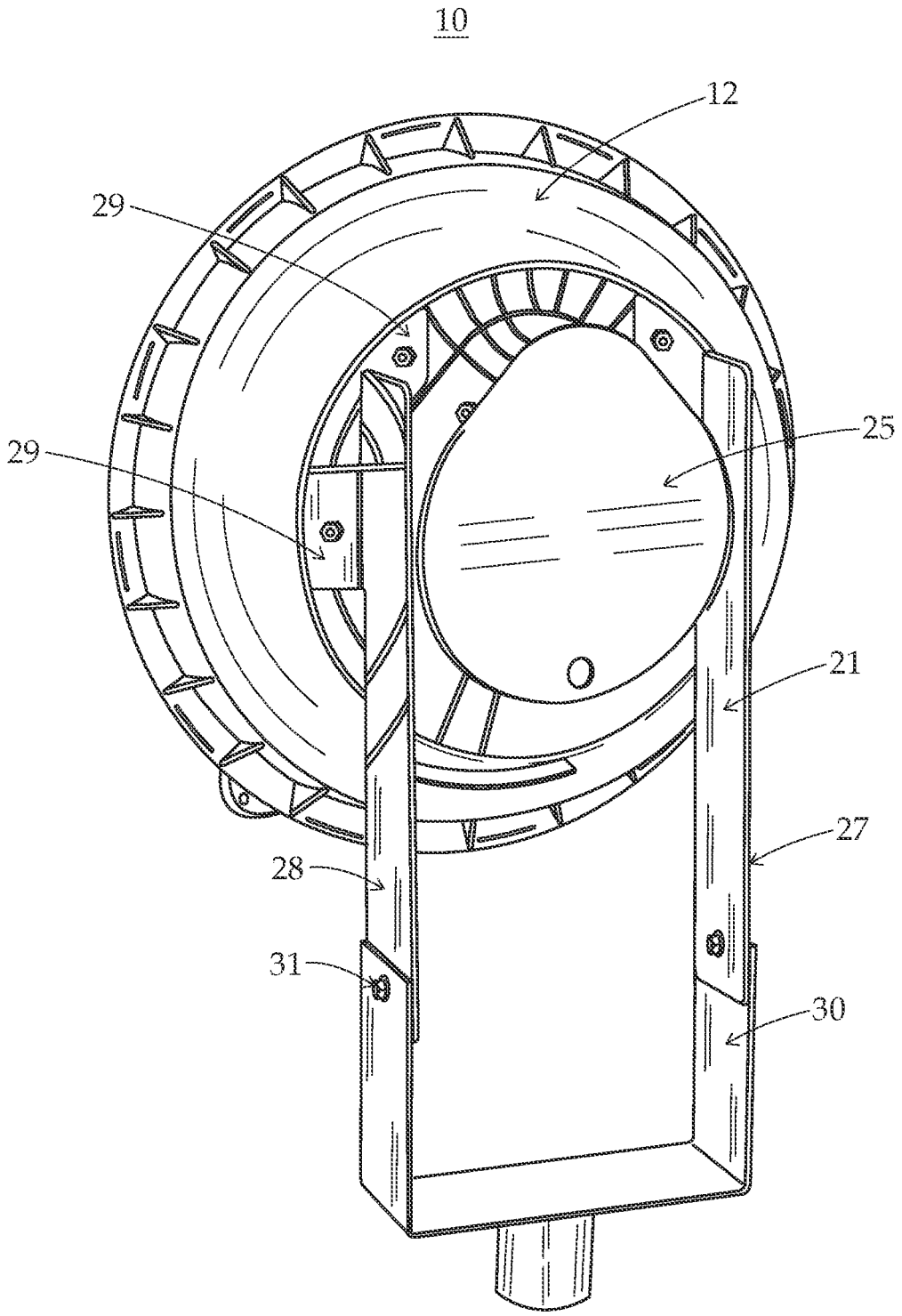
FIG. 5 is a rear view of an embodiment of the lighting fixture of FIG. 1.

FIG. 5. is a rear view of the embodiment of the invention as depicted in FIGS. 2-3. Ballast cover 25 is attached to the rear of housing 12 by appropriate mounting means, such as screws or the like, outside of which attachment members 27 and 28 are added for mounting lighting fixture 10 where desired, by means of pivotal U-bracket 30.

Figure 6:
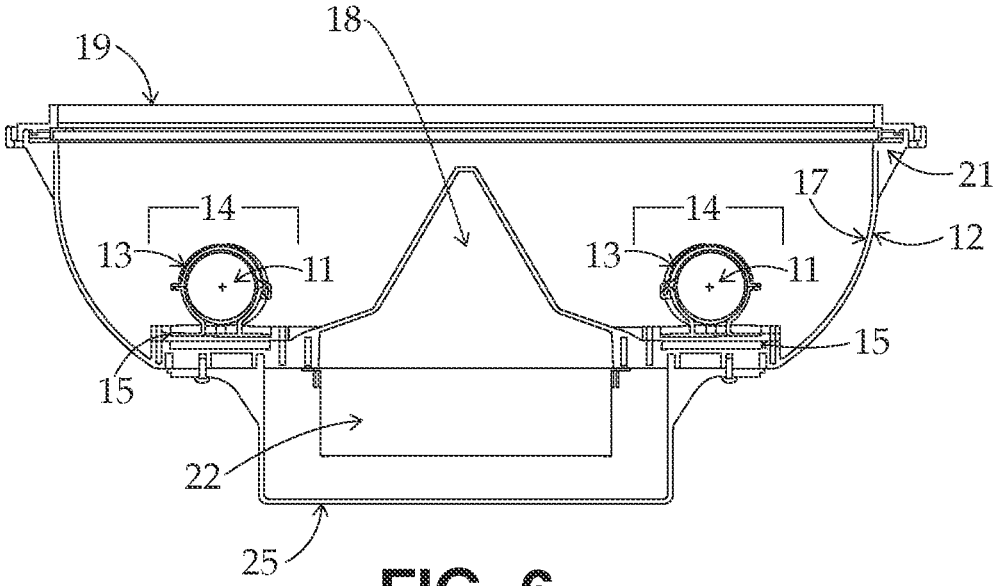
FIG. 6 is a cross-sectional view of an embodiment of the housing element including a magnetic induction lamp assembly.
Figure 7:
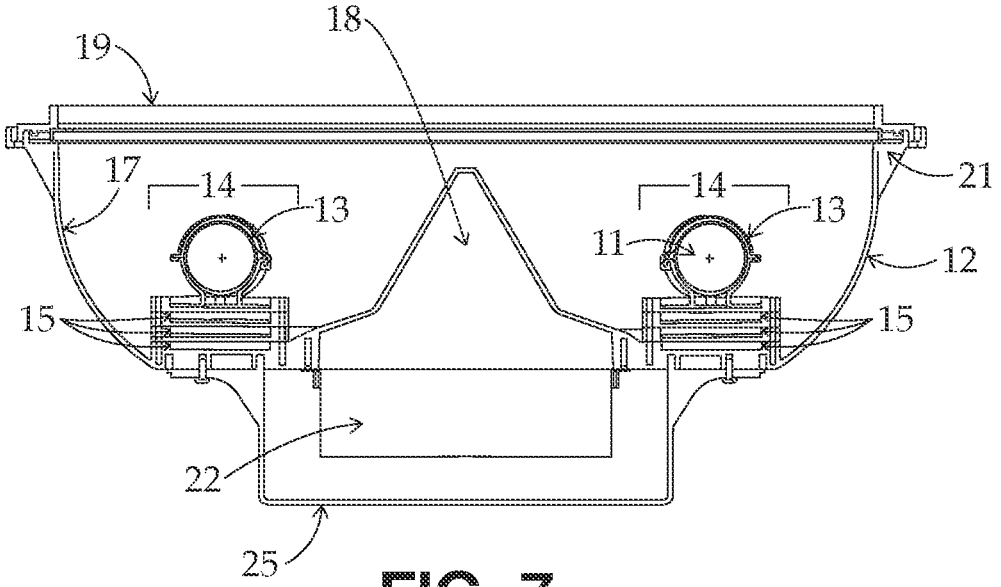
FIG. 7 is a cross-sectional view of an embodiment of the housing element with a magnetic induction bulb assembly, including mounting blocks for adjusting the height of the magnetic induction bulb assembly within the housing.
Figure 9:
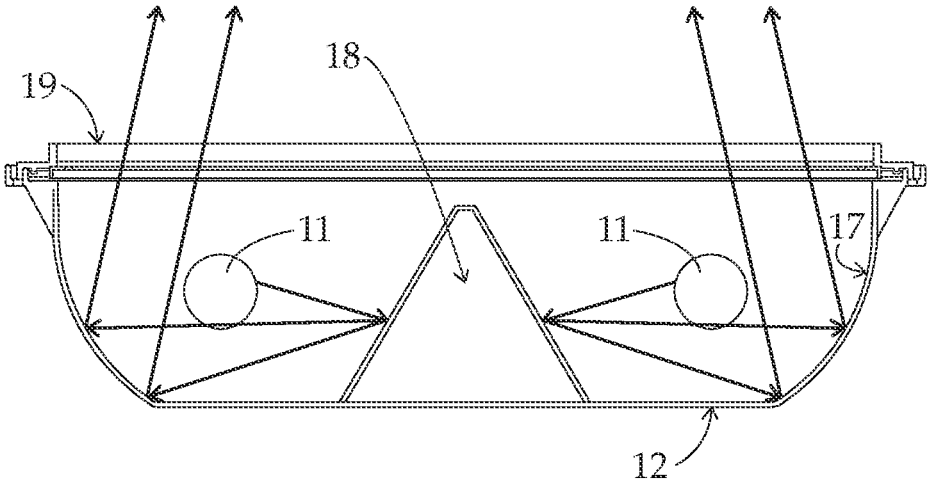
FIG. 9 is a cross-sectional view of an embodiment of the housing element illustrating reflection from a conical primary reflector.

Referring now to FIGS. 6 and 7, which are side cross-sectional views of housing 12 containing bulb assembly 14 connected with adjustment blocks 15 to secondary reflector 17. FIG. 6 shows bulb assembly 14 connected to housing 12 using only a single adjustment block 15 under mounting assemblies 13. In contrast, FIG. 7 illustrates bulb assembly 14 being connected to housing 12 using three adjustment blocks 15 stacked under mounting assemblies 13. In this configuration, bulb assembly 14 is elevated to a higher position, i.e., further away position, from secondary reflector 17. The within invention contemplates that even more than three adjustment blocks 15 for each mounting assembly can be used or, alternatively, as single adjustment block having a thickness greater than shown in FIGS. 6 and 7 can be used, as illustrated in FIGS. 9*b* and 9*c*. In the examples of this embodiment shown in FIGS. 9*b* and 9*c*, bulb assembly 14 is raised to a point so far from secondary reflector 17 as to be outside of housing 12 using heightened mounting blocks 45. See FIGS. 9*b* and 9*c*. As such, conical primary reflector 18 together with secondary reflector 17 provide the ability of housing 12 to disburse and direct light produced by bulb 11 in varying patterns and focal lengths.

Figure 7A:
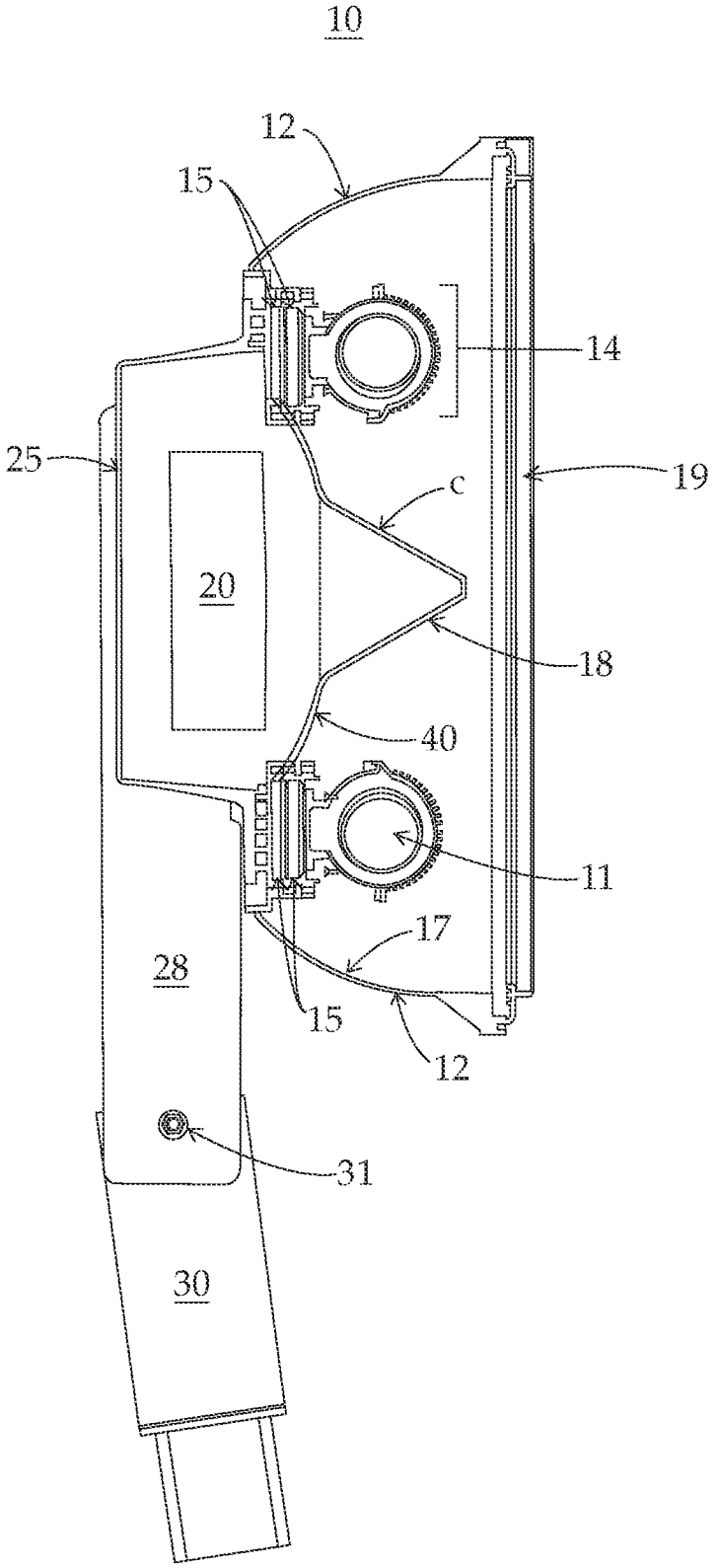
FIG. 7*a* is a side cross-sectional view of an embodiment of the housing element with a magnetic induction bulb assembly, including mounting blocks for adjusting the height of the magnetic induction bulb assembly within the housing, and illustrating the spatial relationship between the bulb and the primary and secondary reflectors.

FIG. 7*a* is a side cutaway view of a further embodiment of the within invention similar to lighting fixture 10 shown in FIG. 2. In this embodiment, the height of bulb assembly 14 as measured from secondary reflector 17 is adjusted using two adjustment blocks 15. Further, conical primary reflector 18 further comprises a lower wall 40, that provides additional reflection properties, depending on the application of lighting fixture 10.

Figure 8:
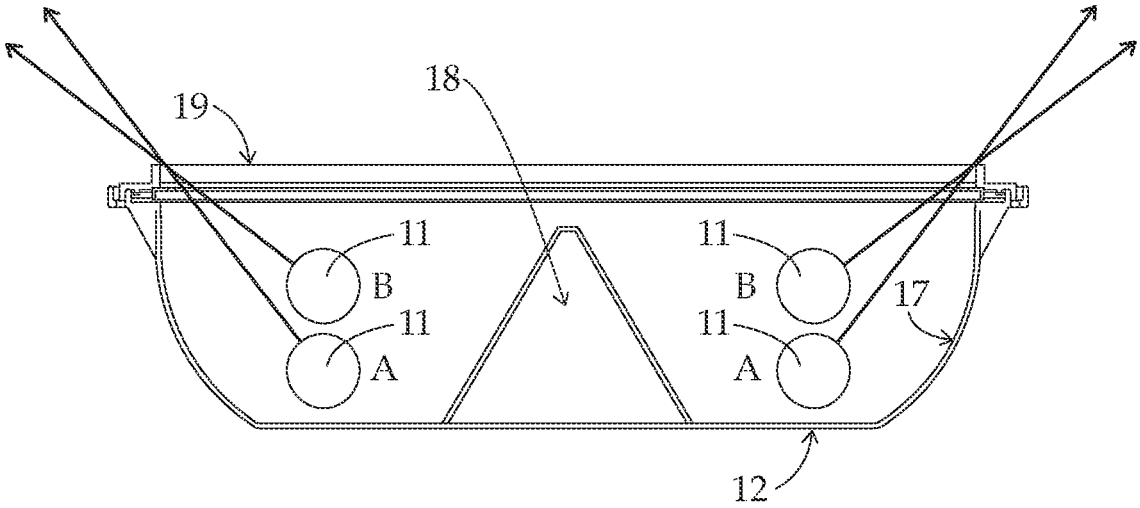
FIG. 8 is a cross-sectional view of an embodiment of the housing element illustrating variation of focal length.

FIG. 8 illustrates generally the effect created by the raising or lowering the position of bulb 11 with relation to changing the focal length of lighting fixture 10. The arrows represent light being emitted from housing 12. By changing the position of tubular induction bulb 11 relative to primary reflector 18 and the surface of secondary reflector 17, seen in FIG. 8 as positions A and B, for example, the focal length of fixture 10 can be changed from narrow to wide or from wide to narrow. The closer that bulb 11 is to the top of lamp housing 12 or lens mounting, the wider the angle of light dispersed from lighting fixture 10. The closer bulb 11 is to the bottom (i.e., deeper within housing 12), the narrower the angle of the light dispersed from the lamp fixture.

Figure 9A:
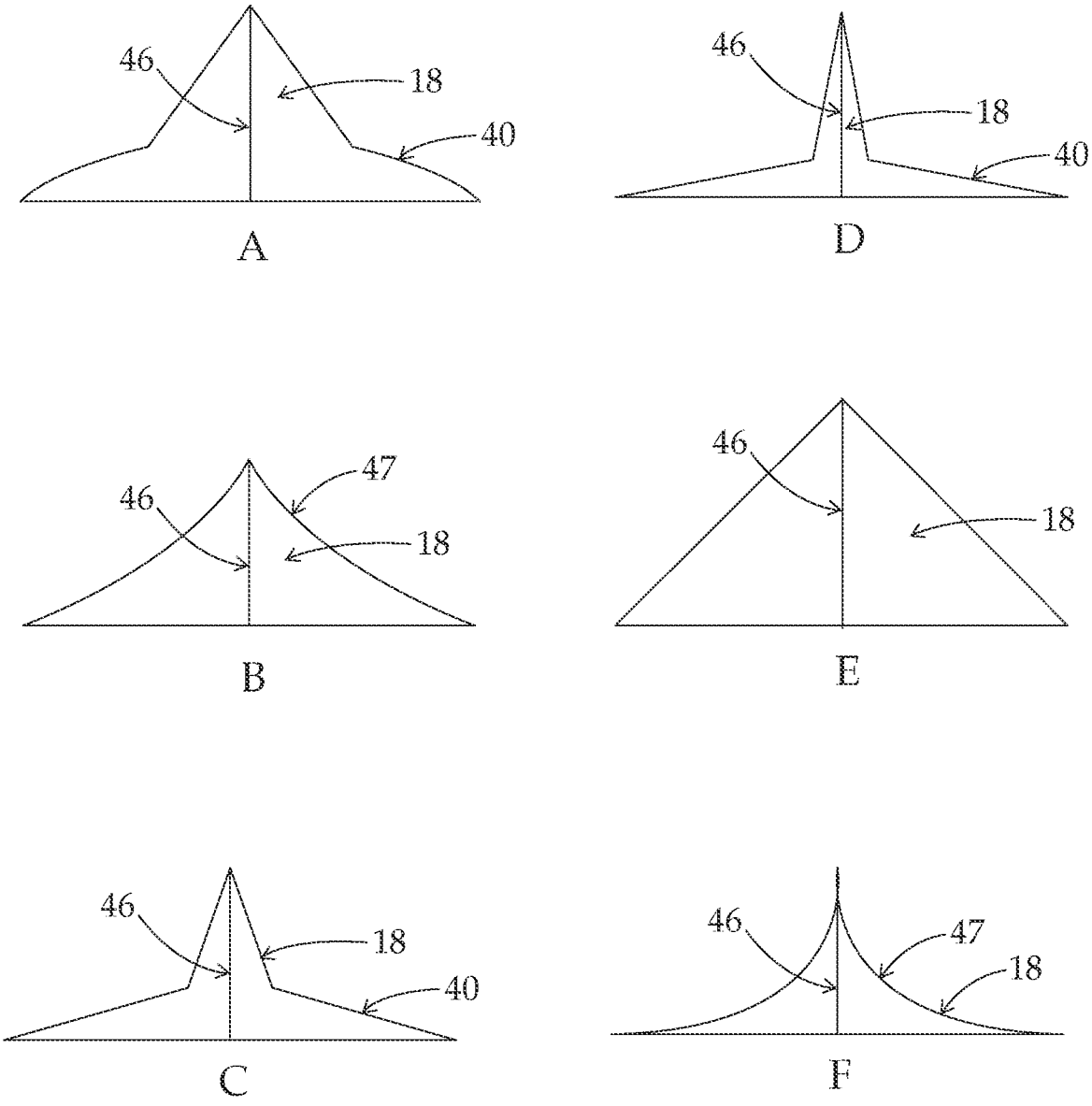
FIG. 9*a* illustrates several configurations for conical primary reflectors.
Figure 9B:
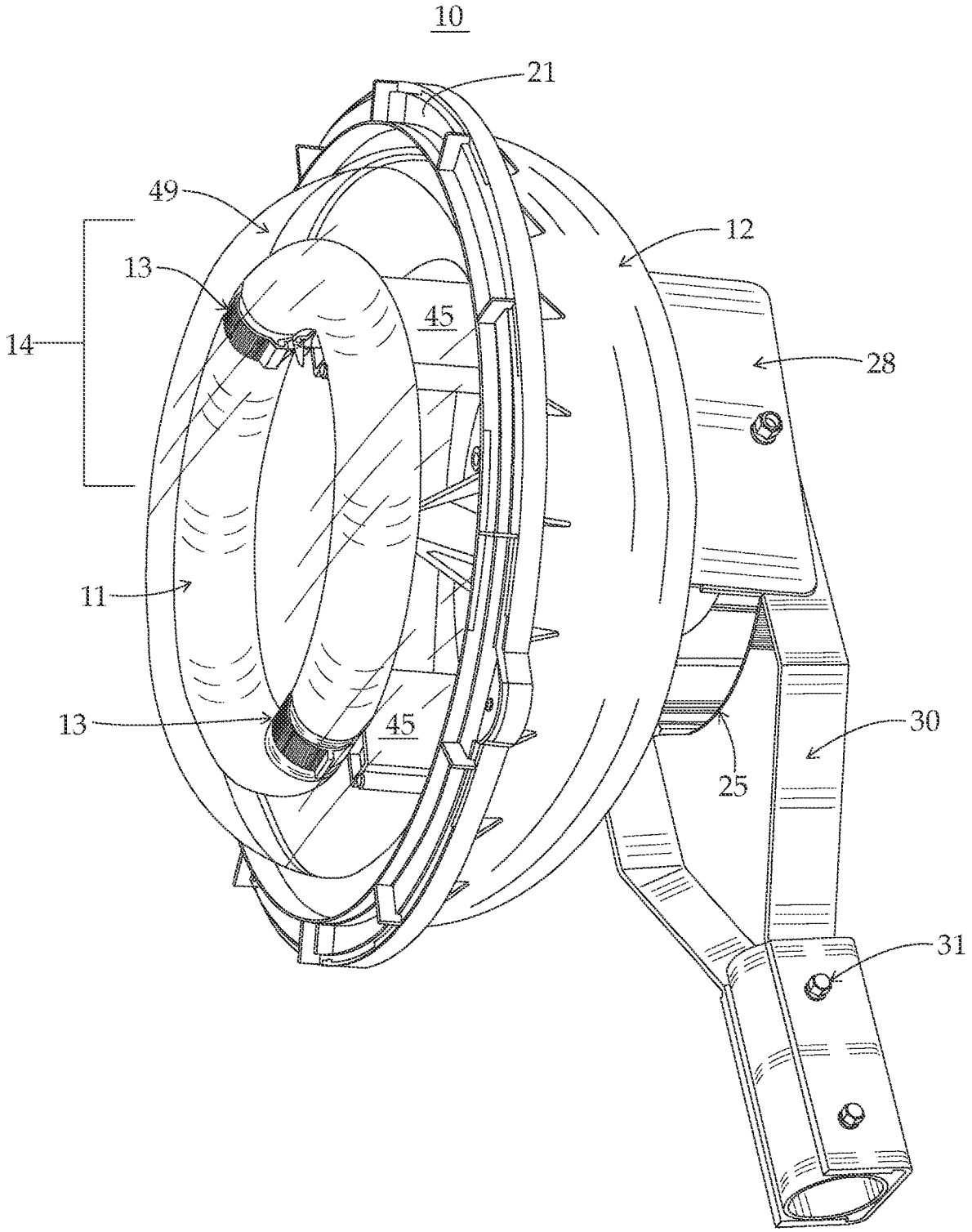
FIG. 9*b* is a side view of a further embodiment of the lighting fixture of the within invention.
Figure 9C:
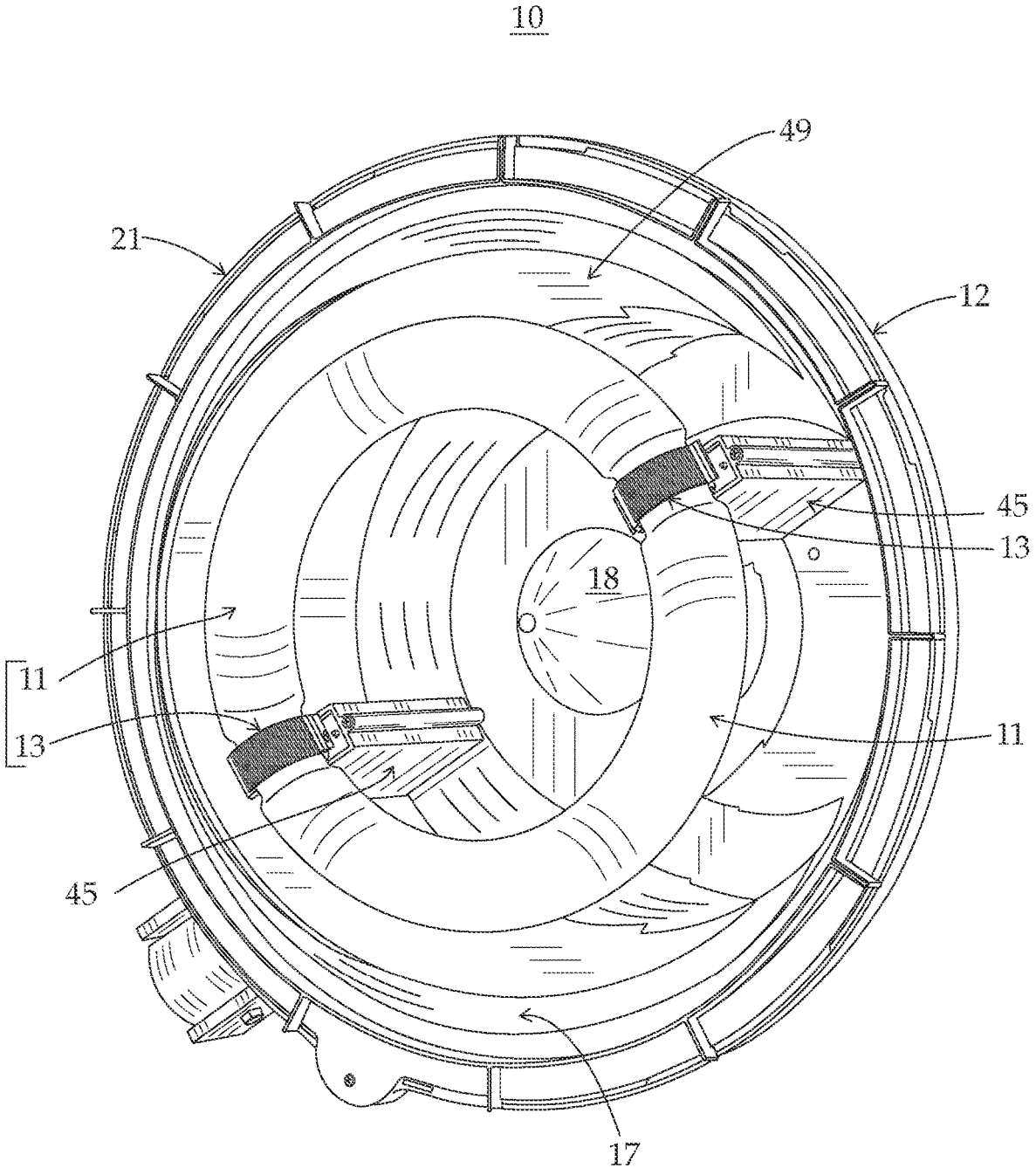
FIG. 9*c* is a top view of the embodiment of the lighting fixture of FIG. 9*b;*

In conjunction with the raising or lowering bulb 11 shown in FIG. 8, conical reflector 18, as the primary reflector, also influences the pattern of light emitted from fixture 10. As illustrated in FIG. 9, conical reflector 18 is designed to reflect light from the interior of tubular induction bulb 11 toward the curved surface of secondary reflector 17 which directs the light out of fixture 10 in accordance with the curvature of housing 12, i.e., secondary reflector 17. The angle, or slope, of conical reflector 18 conforms with the desired light dispersion from the fixture. A more radical angle points light in a tighter pattern while a less radical angle widens the pattern. The angle of conical reflector 18 to bulb 11 can be achieved by either varying the angle of the walls of conical reflector 18 or moving the tubular induction bulb 11 vertically up or down within housing 12 relative to the fixed conical reflector 18. In the preferred embodiment, the conical reflector 18 comprises an angle of about 45°, although this angle may vary from at least 30° to a maximum of 70° depending on the dimensions, etc, of bulb 11. Moreover, the angle of the conical reflector can be selected in relation to the circumference of tubular bulb 11, according to the relationship:

FIG. 9*a* illustrates further configurations of conical primary reflector 18 contemplated by the within invention, having different arcs 47, slopes and bases 40. The superior reflection properties of the lighting fixtures 10 of the within inventions are obtained largely by the combination of conical primary reflector 18 and secondary reflector 17. Referring now to FIGS. 7*a* and 9*a*, inter alia, the geometry of the internal area secondary reflector 17 is from a 90° angle to a 0° angle into a round, arching bottom that runs into the center of conical reflector 18, which may also be removable and interchangeable with other conical reflector configurations shown in FIG. 9*a*. See FIG. 11. The angle of the cones of reflector 18 may vary from 90° to 0°, as measured in accordance with the cones' height 46. Heights and widths of the internal bulb housing area vary according to the spectrum and focal length of the light needed. The higher and wider the side walls and inner cone, the more the light path will produce a flood pattern (FIGS. 8 and 9), the higher and narrower the angles are the light path will be more of a spot path. As light assembly 14 moves upward in housing 12, or drop the bulb 11 below the rim, the light path will flood, making a custom adjustment. As the angles and lengths of the outer wall of secondary reflector 17 and primary reflector 18, the light path is customized for each application. Also, using different arcs and angles within housing 12 allows for even more variability for custom results. Referring to FIG. 7*a*, outer wall of housing 12 could be as high as 48" with angles ranging from 90° to 0°. The circular arc between bulb 11 and reflector cone 17 will remain constant, replicating the direct circumference of bulb 11. The raised reverse arc 40 angle from the flat bottom to the center of primary reflector 18 in lower wall 40 will change to custom tailor the light pattern produced. FIGS. 9*a* C and D. As an example, FIG. 9*a* C's center angles will change in direct relationship to bulb 11's shape and wattage and will affect the light being reflected and the shape of the bulb.

Figure 9D:
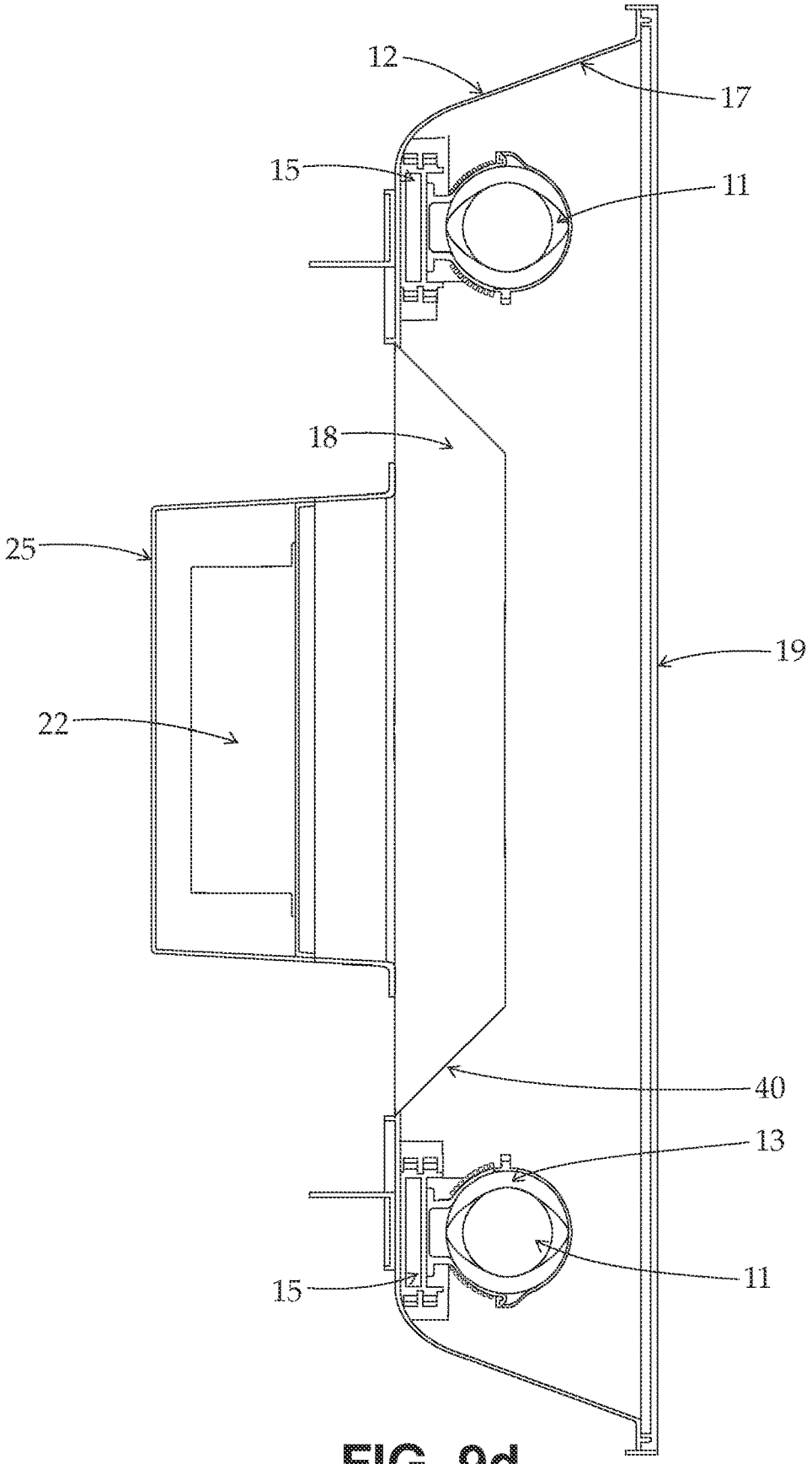
FIG. 9*d* is a side view of a further embodiment of the lighting fixture of the within invention.
Figure 9E:
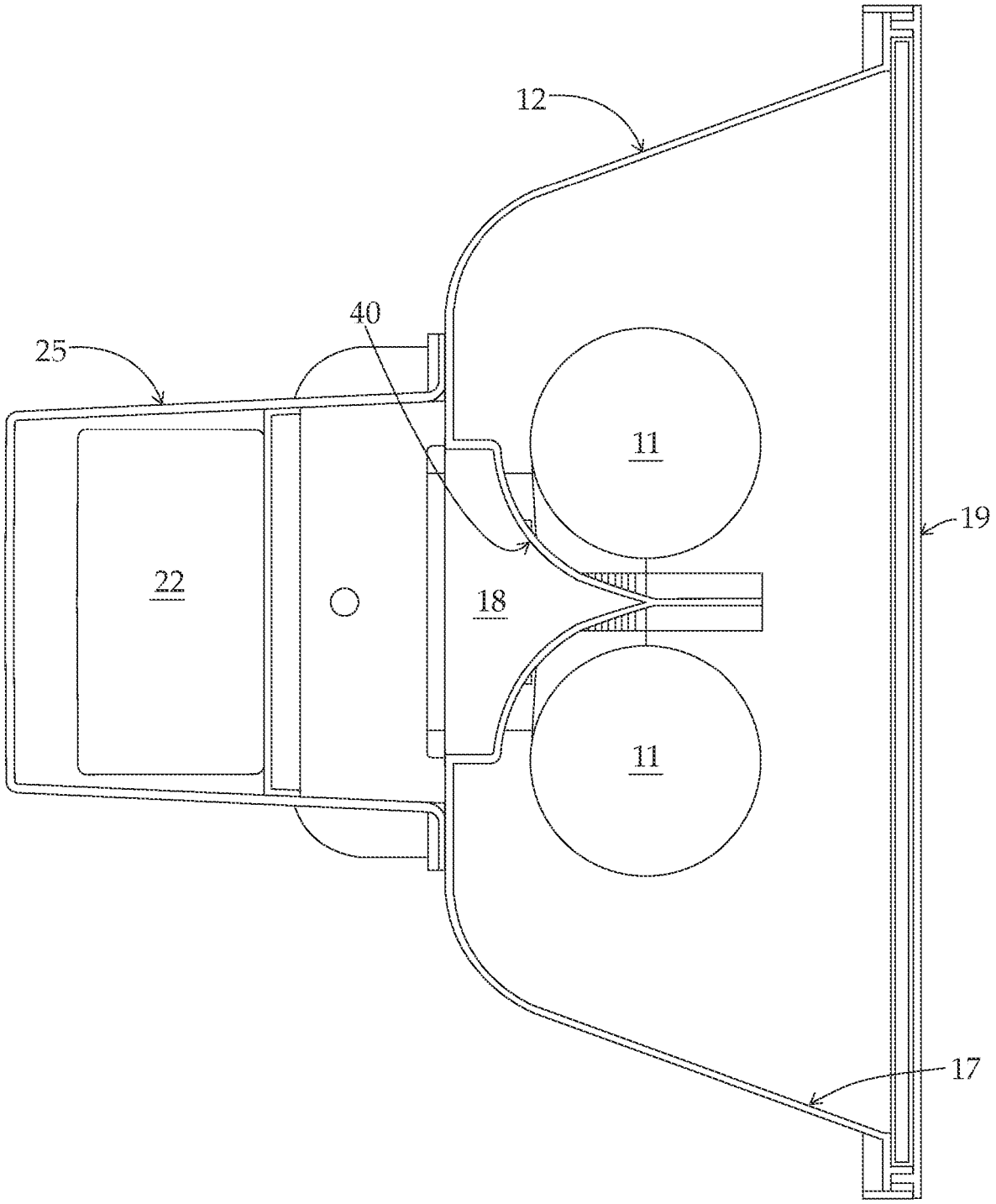
FIG. 9*e* is a side view of a further embodiment of the lighting fixture of the within invention.

With a square or rectangular fixture and bulb assembly, FIGS. 9*d* and 9*e*, the central adjustment points will also change in relation to the lighting application situation. Primary reflector 18's conical center and angled lower wall 40 in between the bulbs 11 changes as the wattage of the bulb changes as well as the shape of the fixture. A round fixture 10 may have removable and interchangeable primary reflectors 18 and a rectangular fixture as in FIG. 9*d* will have an angled wall, but the lower reverse-angle wall 40 will change as well as the side wall of housing 12.

The main body bulb housing 12 outside wall height, together with the circular, square or other shape bulb housing having a wall thickness of 3/16" and an outside wall height of 3"-48." The 0-90° curvature of the wall of housing 12 in relation to the angular inner adjustable interchangeable reflector cone 18 results in a reflected light far superior to those known in the field.

FIGS. 9*b* and 9*c* illustrate another embodiment of light fixture 10 of the within invention where bulb assembly 14 is raised to a point that it protrudes above housing 12. FIG. 9*b* is a perspective side view of this embodiment, having a heightened adjustment block 45 as compared to adjustment blocks 15 in other embodiments. Heightened adjustment block 45 is such that bulb assembly 14 protrudes above housing 12 which significantly alters the reflection of light from bulb 11 and provides a very wide angle of light from fixture 10. Accordingly, glass window 49 becomes extended and bowed in comparison to its counterpart glass window 19 seen in FIGS. 1-3, to accommodate the extension of bulb assemble 14 to outside housing 12.

Figure 10:
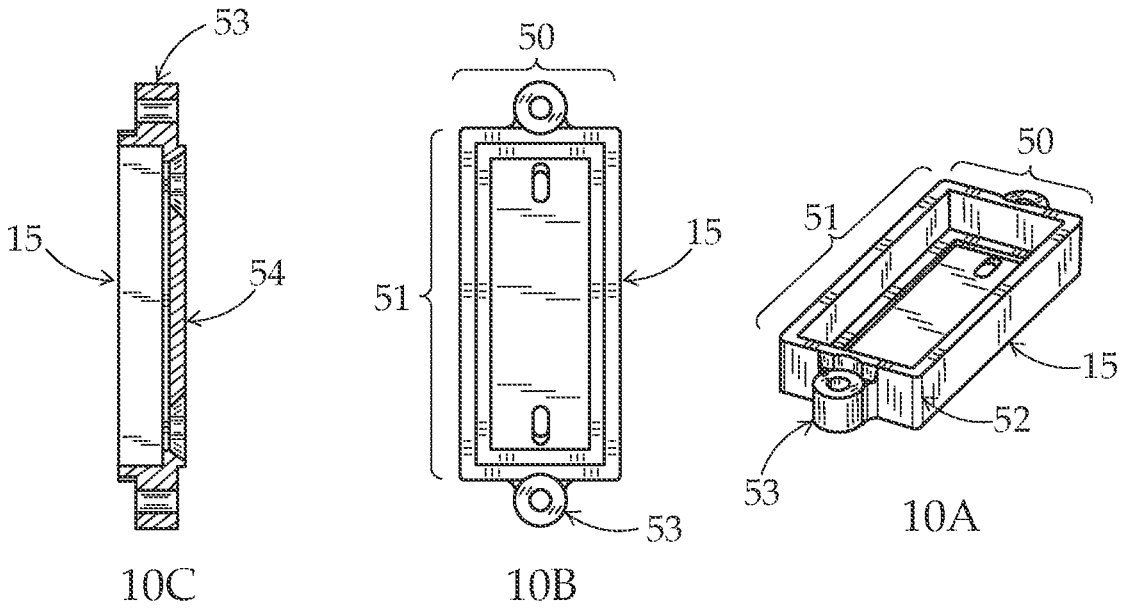
FIG. 10 is a view of an embodiment of the mounting block element of the invention.

FIG. 10 shows three views of mounting adjustment block 15, which has a general flat, rectangular shape. Adjustment block 15 has a length dimension 51, a width dimension 50 and a height dimension 52, and is essential hollow with one side 54 being solid. Adjustment block 15 is constructed with any lightweight material that is durable and heat resistant such as plastics or similar polymers being preferred. At each end of adjustment block 15 are protrusions 53 having holes through which screws are inserted for attaching block 15 to the inside of housing 12. The height dimension 52 of the block can range from about 1/8" to about 1", depending on the overall dimensions of the lighting fixture, such that one or more of block 15 can be stacked together to reach a desired distance for raising mounting assembly 14 within housing 12. In addition, where a more substantial height of adjustment block 15 is needed, a larger block can be used, such as adjustment block 45 seen in FIGS. 9*b* and 9*c*. The height of adjustment block 45 can range from 1" to several inches, as necessary to achieve the desired result.

Figure 11:
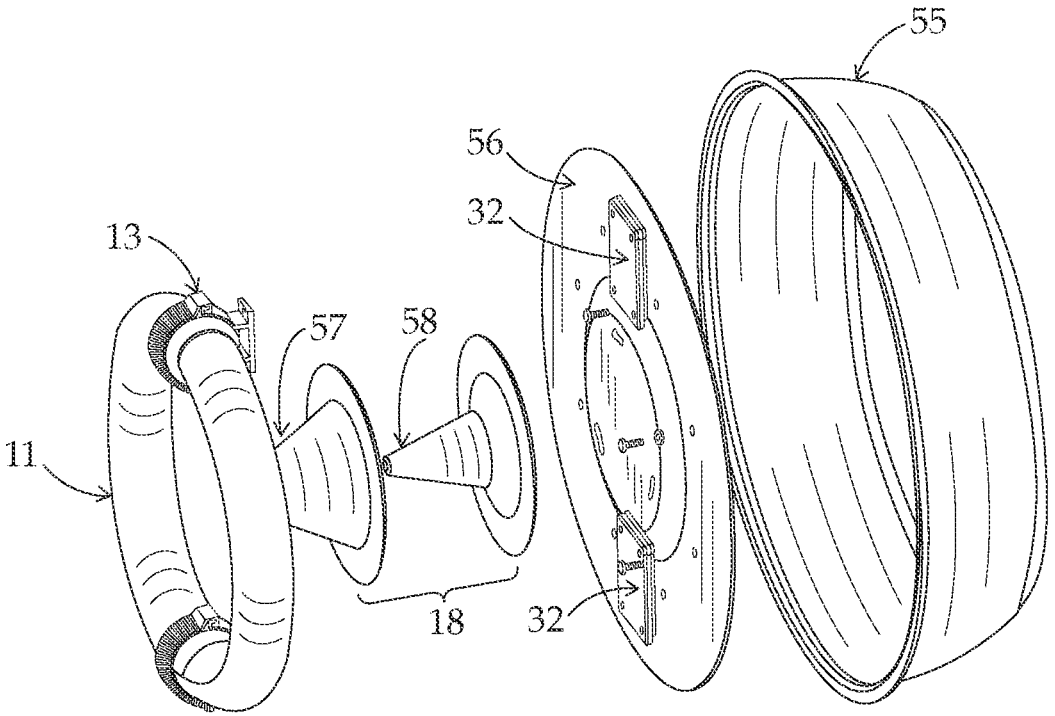
FIG. 11 is an expanded view of a further embodiment of the housing of the within invention illustrating the interchangeability of the primary reflector.

FIG. 11 is an exploded view of an embodiment of this invention that illustrate the variability of primary reflector 18 by exchanging it with reflectors of the different configurations as may be shown in FIG. 9*a*. For example, referring to FIG. 11, reflectors 57 and 58 correspond to configurations E and A of FIG. 9*a*. In this embodiment, primary reflector 18 is not an integral part of housing 12 but is detachably mounted on reflector plate 56 which forms a base plate for alternative housing 55. That is, once primary reflector 18 is mounted on reflector plate 56, reflector plate 56 is inserted into alternative housing 55 and forms the back part of that housing. The effect of selecting different configurations for reflector 18 is that different configurations alter the angle of reflection of the lighting fixture interior which can also modify the fixtures focus as well as light distribution and dissipation patterns.

The preceding preferred embodiments are illustrative of the practice of the invention. It is to be understood, however, that other expedients known to those of skill in the art, or disclosed herein, may be employed without departing from the spirit of the invention or the scope of the claims.

What is claimed is:

1. A lighting fixture for providing improved light reflection and variable focal lengths for a tubular magnetic induction bulb, said lighting fixture comprising;

a housing configured to conform to the geometry of said tubular magnetic induction bulb, said housing comprising an internal side and an external side, and said housing configured to the shape of the tubular magnetic induction bulb;

a tubular magnetic induction bulb assembly comprising said tubular magnetic induction bulb and at least one assembly for mounting said tubular magnetic induction bulb to said inside of said housing;

a primary reflector element, positioned on the internal side of said housing, said primary reflector element comprising a conical or pyramidal protuberance positioned in the center of said internal side of said housing, wherein said primary reflector element is configured in proportion to the tubular magnetic induction bulb;

at least one height adjustment mechanism positioned between said tubular magnetic induction bulb assembly and said internal side of said housing;

wherein said internal side of said housing comprises a secondary reflector surface, such that said secondary reflector surface reflects light from the tubular magnetic induction bulb and light reflected from the primary reflector element that is directed to the secondary reflector surface;

wherein the combination of the primary reflector element and the secondary reflector surface provide for maximum reflectance of light from said tubular magnetic induction bulb said reflectors further being designed to disburse light from said lighting fixture in varying patterns; and wherein the focal length and light disbursement pattern of said fixture may be varied by raising or lowering said tubular magnetic induction bulb assembly using said height adjustment mechanism.

2. The lighting fixture of claim 1 wherein, said primary reflector element comprises a cone and wherein said housing and said primary reflector cone comprise a uniform single extruded or molded unit designed for the geometry of the tubular magnetic induction bulb.

3. The lighting fixture of claim 1 wherein, said primary reflector element is detachably mounted to said secondary reflector surface.

4. The lighting fixture of claim 1, wherein said at least one height adjustment mechanism comprises one or more height adjustment blocks to raise or lower said bulb assembly with respect to said primary reflector element and said secondary reflector surface of said fixture, and in proportion to said primary reflector element, such that the focal length of said fixture can be changed.

5. The lighting fixture of claim 1, wherein said at least one height adjustment mechanism comprises one or more height adjustment blocks to raise or lower said bulb assembly with respect to said primary reflector element and said secondary reflector surface of said fixture, and in proportion to said primary reflector element, such that said dispersion pattern of said disbursed light from said fixture can be changed.

6. The lighting fixture of claim 4, wherein said height of said tubular magnetic induction bulb assembly is adjusted by the addition or removal of said at least one or more height adjustment blocks.

7. The lighting fixture of claim 5, wherein said height of said tubular magnetic induction bulb assembly is adjusted by the addition or removal of said at least one or more height adjustment blocks.

8. A lighting fixture configured to conform to the geometry of a tubular magnetic induction bulb, said lighting fixture comprising;

a housing comprising an internal reflector side and an external side, said housing configured in the shape of the tubular magnetic induction bulb such that the tubular magnetic induction bulb fits inside said housing;

a reflector, positioned on the internal side of said clamshell base, said reflector comprising a conical or triangular portion molded into said reflector at its center and configured in proportion to the tubular magnetic induction bulb, said reflector designed to disburse light from said lighting fixture in varying patterns;

a tubular magnetic induction bulb assembly comprising a tubular magnetic induction bulb, and an attachment mechanism for attaching said assembly to said reflector;

a mechanism for raising the and said tubular magnetic induction bulb assembly, wherein a light dispersion pattern and focal length of the fixture are made variable; and a ballast cover to incorporate a ballast and ballast electronics into said lighting fixture and a mounting bracket for mounting said lighting fixture.

9. The lighting fixture of claim 8 wherein, said housing and said reflector comprise a uniform single extruded or molded unit designed for the geometry of the tubular magnetic induction bulb.

10. The lighting fixture of claim 8 wherein, said reflector is removably attached to said housing.

11. The lighting fixture of claim 8, wherein said mounting bracket comprises attachment members pivotally connected to a U-bracket.

12. The lighting fixture of claim 8, wherein said mounting bracket comprises a U-bracketing system.

13. The lighting fixture of claim 8, wherein said mounting bracket is configured for mounting onto a pipe.

* * * * *